United States Patent [19]

Kuck et al.

[11] Patent Number: 4,653,129

[45] Date of Patent: Mar. 31, 1987

[54] SIDE RAIL ASSEMBLY FOR A WHEELED STRETCHER

[75] Inventors: Jay L. Kuck, St. Marys, Ohio; Terry J. Simpkins, Snowmass Village; David P. Harris, Aspen, both of Colo.

[73] Assignee: Midmark Corporation, Versailles, Ohio

[21] Appl. No.: 855,998

[22] Filed: Apr. 25, 1986

[51] Int. Cl.[4] ..... A47C 21/08; A47G 7/00

[52] U.S. Cl. ..... 5/430; 5/63

[58] Field of Search ..... 5/430, 428, 425, 100, 5/60, 63

[56] References Cited

U.S. PATENT DOCUMENTS

| | | | |
|---|---|---|---|
| 3,506,989 | 4/1970 | Ross et al. | 5/430 |
| 3,604,024 | 9/1971 | Polanski | 5/430 |
| 4,509,217 | 4/1985 | Therrien | 5/430 |

*Primary Examiner*—Alexander Grosz

*Attorney, Agent, or Firm*—Biebel, French & Nauman

[57] ABSTRACT

A side rail assembly for a bed-like stretcher includes a tubular side rail with first and second tubular posts connected at each end. Each of a pair of mounting members connected near each end of the stretcher frame includes first and second vertically spaced-apart pivotal connection points. First and second linkage bars are pivotally connected between each of the posts and the connection points of one mounting member to form a pivotally connected quadrilateral. A handle is mounted to each of the posts for pivotal movement about a horizontal line, while a handle linkage connects the handles so that movement of either handle causes identical movement by the other. A latch on each post cooperates with a catch fixedly attached to the frame. A latch actuator connects each latch with a handle, so that pivotal movement of either handle causes the latches to disengage from the catches, permitting lowering of the side rail assembly.

10 Claims, 6 Drawing Figures

SIDE RAIL ASSEMBLY FOR A WHEELED STRETCHER

BACKGROUND OF THE INVENTION

The present invention relates generally to wheeled stretchers typical of those used in hospitals. More particularly, this invention relates to a raisable and lowerable side rail assembly provided along each side of the stretcher to prevent a patient from falling from the stretcher.

Various types of bed-like equipment are commonly used in hospital and other health care facilities. Most common is the typical hospital bed, typically provided in a patient's room. Where the patient is a child, a crib may be used. Stretchers, normally provided with wheels for ease of movement, are used in a variety of situations.

One common type of wheeled stretcher is often used in emergency room settings, as well as in general hospital service for transporting patients from one location to another. Such a stretcher is of relatively heavy-duty construction, and includes a base supported by a plurality of wheels, the base in turn supporting the stretcher frame to which a bed portion is attached. As with most other hospital bed-like equipment, such a stretcher is normally provided with side rails which may be selectively raised or lowered. While the side rails must be capable of securely holding the patient on the stretcher, they must also be capable of sufficient movement out of the way to enable the patient to move or be moved from or onto the stretcher.

A number of means for mounting the side rails in movable fashion are known. For example, the side rails may be constructed to move upwardly or downwardly, in a vertical plane, in a fashion similar to the side rails of a crib. The side rail assemblies may also be pivotally connected at their lower ends so that each side rail may be swung outwardly and then beneath the stretcher table. As a third alternative, the side rail assembly may be constructed so as to fold flat against the stretcher table in the direction of the rails themselves.

In U.S. Pat. No. 4,509,217 issued to Therrien, a side rail mounting assembly is shown for use with a hospital bed. Unlike the assemblies noted above, the side rail in Therrien is connected to the bed frame through a pair of linkage bars at each end of the side rail that effectively define a parallelogram. The rail assembly is then movable in a vertical plane, but with a pivot-like motion, for raising and lowering of the assembly. A locking mechanism is provided with the linkage at each end of the side rail assembly. The locking mechanism is located so as to engage both a linkage bar and the bed frame, with the result that the mechanism is postioned at both the head and foot ends of the bed, generally below the surface of the bed itself.

It is important in designing a stretcher to provide for lowering of the side rail assemblies in such a manner that they are moved well our of the way of the bed surface of the stretcher. This is important since in many instances it will be desirable to move a patient directly from the stretcher onto another surface, such as a bed or an examination table. This transfer is facilitated the closer the stretcher can be positioned to the corresponding equipment. Moreover, stretchers of the type considered here are frequently used in situations, such as emergency room settings, where it may be necessary for hospital personnel to gain access quickly to a patient to administer emergency care. In this regard, the Therrien mounting arrangement is disadvantageous in that one must first move to either the head or foot end of the bed, and then reach to a lower position in order to manipulate the locking mechanism to permit the side rail to be lowered. Thus, the attention of the attendant must be taken off the patient. Further, the lowering operation must be conducted with two hands, since one hand is required to release the locking mechanism, and the second is required to grip the side rail to prevent it from dropping once it has been unlocked.

What is needed, therefore, is a mounting arrangement for a side rail for a stretcher that enables an operator to release and lower the side rail with a one-handed motion, and that enables the operator to do so without leaving the side of the patient. Further, the side rail must be lowered in such a manner that little space is required around the stretcher, and in such a manner that the side rail assembly is positioned out of the way after it has been placed in a lowered position.

SUMMARY OF THE INVENTION

In meeting the foregoing needs, the present invention provides a side rail assembly for a bed-like stretcher, wherein the stretcher includes a frame having first and second ends for supporting a bed surface. The assembly includes a tubular side rail having first and second ends, with first and second tubular posts being connected at each of the first and second ends of the side rail. A pair of mounting members are connected to the frame, with one of the members connected near each end of the frame. Each mounting member includes first and second vertically spaced-apart pivotal connection points.

A pair of first linkage bars are provided, with each of the bars pivotally connected between one of the posts and the first connection point of one of the mounting members. A pair of second linkage bars are also provided, with each of the second bars pivotally connected between one of the posts and the second connection point of one mounting member. The linkage bars are connected such that a corresponding one of each of the first and second linkage bars, the mounting members, and the posts define a quadrilateral having pivotal connections at each corner thereof.

First and second handles are mounted to each of the first and second posts for pivotal movement about a horizontal line. A handle linkage means connects the first and second handles so that movement of either of the handles causes identical movement by the other. A latch means is connected to each of the posts for cooperating with catch means fixedly attached to the frame. A latch actuator means connects each latch means with one of the handles, so that pivotal movement of the handles causes the latch means to disengage from the catch means, permitting lowering of the side rail assembly.

Accordingly, it is an object of the present invention to provide a mounting arrangement for attaching a side rail assembly to a bed-like stretcher; to provide such a mounting arrangement in which the side rail may be selectively raised or lowered; to provide such a mounting arrangement in which the side rail may be lowered to a position beneath the bed surface of the stretcher; and to provide such a mounting arrangement in which the side rail may be lowered by an attendant with one hand, from a standing position and from either end of the side rail assembly.

Other objects and advantages of the present invention will be readily apparent from the following description, the accompanying drawings, and the appended claims.

DETAILED DESCRIPTION OF PREFERRED EMBODIMENT

The present invention is generally applicable to a wheeled, bed-like stretcher typically found in hospital emergency rooms and other hospital environments. The invention provides a mounting arrangement for a side rail used to prevent a patient lying on the stretcher from inadvertently falling from the stretcher. However, it will be recognized that the present invention is also usable with other bed-like devices, including hospital beds, cribs, and the like.

Figure 1:
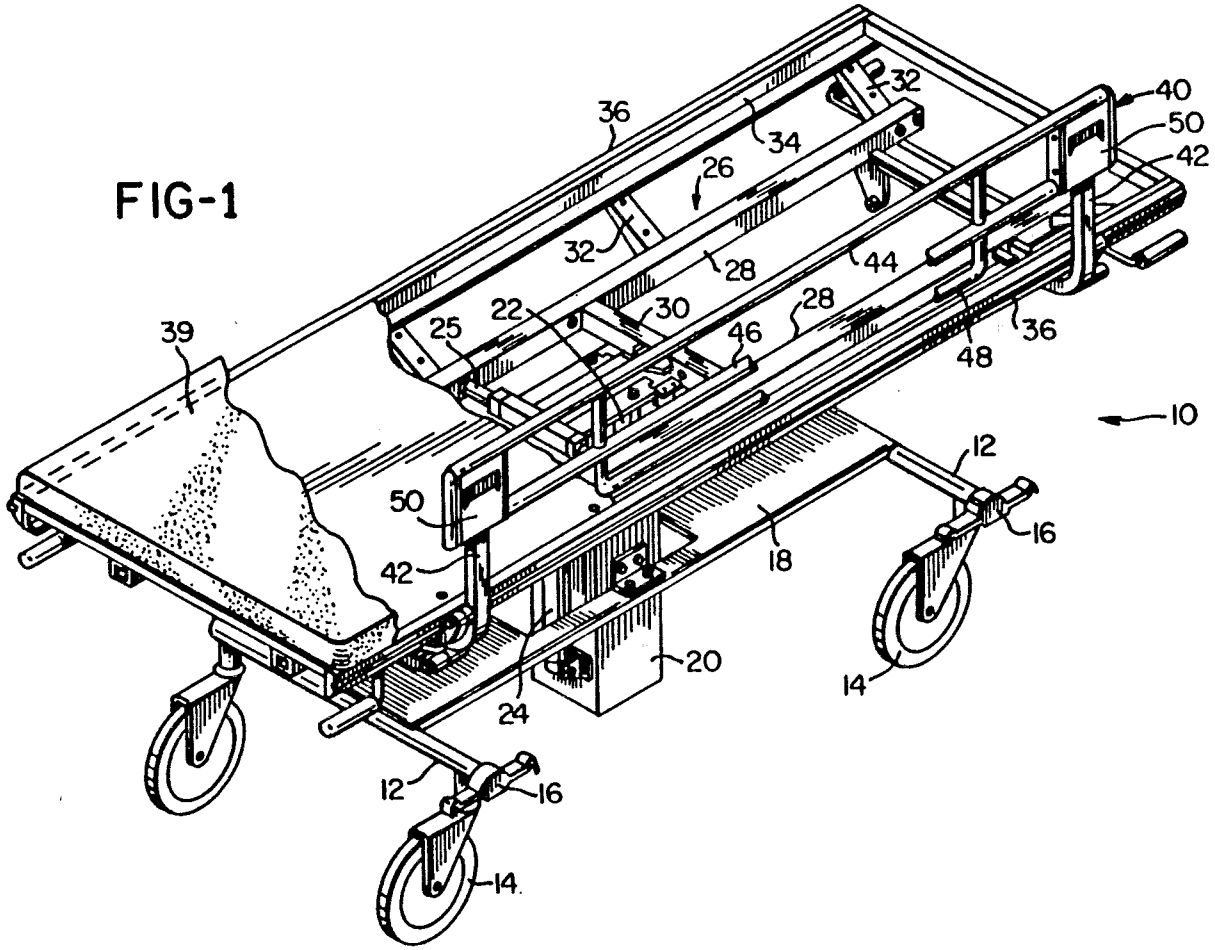
FIG. 1 is an isometric view of a bed-like stretcher having a side rail secured by a mounting arrangement in accordance with the present invention.

Referring generally to FIG. 1, a stretcher 10 is shown having a wheeled base including supportive cross members 12. A wheel assembly 14 is provided at each end of the members 12, and a brake mechanism 16, the structure of which is well known in the art, is provided for locking the wheels to prevent movement of stretcher 10 when desired.

Cross members 12 are connected by a base plate 18, which in turn supports a hollow vertical column 20. Slidably mounted within column 20 is a primary post 22. Post 22 and column 20 are interconnected by a hydraulic cylinder 24, which may be actuated by suitable controls such as a foot pump (not shown) to raise post 22 with respect to column 20. This provides a vertical adjustment for stretcher 10.

Post 22 is connected by an axle 25 to a stretcher frame 26. Frame 26 includes a pair of longitudinal frame members 28, connected by at least one lateral cross member 30. A plurality of braces 32 are secured to frame members 28 in an outward and upward inclined fashion. Braces 32 in turn support peripheral frame members 34, one member 34 extending along each side of frame 26. Each peripheral member is preferably formed as an aluminum extrusion. Inserted into the outer surface of each peripheral frame member 34 is a rubber or plastic bumper strip 36. Members 34 also support bed surface 38, upon which an appropriate mattress 39 is placed.

To prevent a patient occupying stretcher 10 from accidentally falling from the stretcher, a side rail assembly 40 is provided along each side of the stretcher. Only a single side rail is shown in FIG. 1 for purposes of clarity, but it will be understood that an identical side rail assembly 40 is mounted in identical fashion to the side of stretcher 10 shown toward the rear in FIG. 1.

Side rail assembly 40 includes an upright post 42 located at each end of assembly 40. Three parallel side rails 44, 46 and 48 are connected between posts 42 and provide the protective function of assembly 40. One requirement of side rail 40 assembly is that it be capable of selective lowering to enable the patient to be moved onto or off of the stretcher. Accordingly, handles 50 are provided near the top of each post 42 and are operative as will be discussed in detail below to release the side rail assembly 40 for lowering beneath the bed surface.

Figure 2:
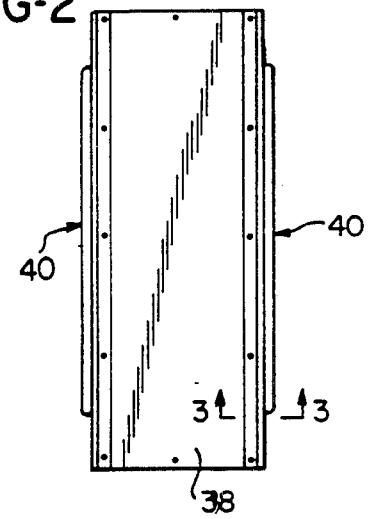
FIG. 2 is a top plan view of the stretcher.
Figure 2:
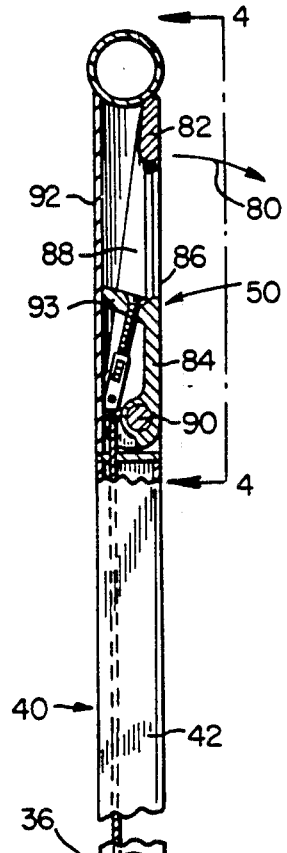
Figure 3:
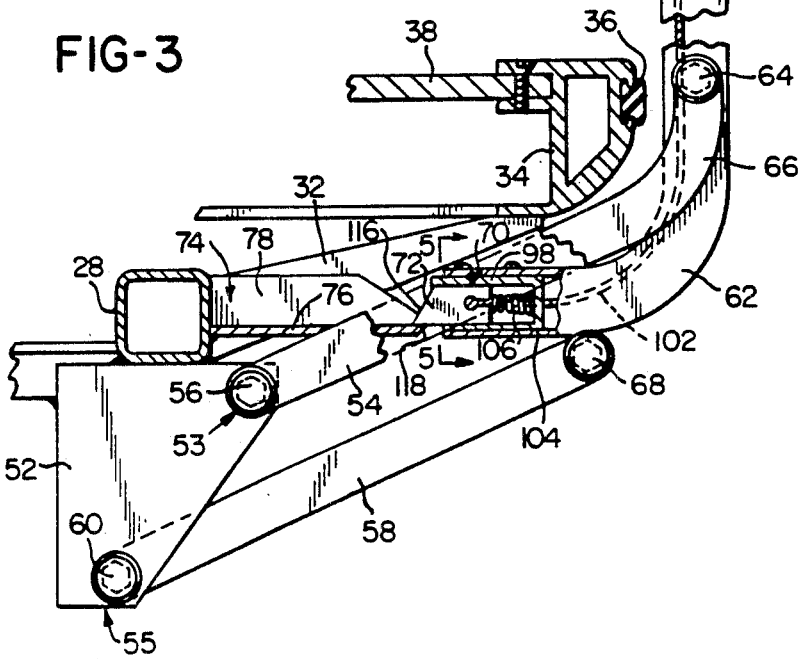
FIG. 3 is a sectional view of the stretcher side rail, and mounting arrangement taken generally along line 3—3 in FIG. 2.

The means by which the side rail 40 is mounted to stretcher 10 may be seen from FIG. 3, which is a partial sectional view taken as indicated generally in FIG. 2. A mounting plate 52 is secured to longitudinal frame member 28 to extend downwardly therefrom near the desired location for post 42 of side rail assembly 40. Plate 52 includes upper and lower mounting positions 53 and 55, respectively. A first linkage rod 54 is connected at the upper mounting position 53 by a bolt 56, while a second linkage rod 58 is connected to the lower position 55 by a bolt 60.

Rods 54 and 58 are connected at their opposite ends to post 42. Post 42 is generally vertically oriented, but includes a curved portion 62 located near the lower end of post 42 so that the lower end of the post extends horizontally and inwardly with respect to the stretcher. In addition, post 42 is hollow, and is preferably provided with a square cross-section.

Rod 54 is connected by a bolt 64 to post 42 above curved portion 62. Rod 54 is provided with its own curved portion 66 to enable rod 54 to clear peripheral frame member 34. Rod 58 is attached by bolt 68 to post 42 at a point beneath curved portion 62. All four connections of rods 54 and 58 are pivotal, so that rods 54 and 58 operatively define a quadrilateral. The post 42 at the opposite end of side rail assembly 40 is similarly mounted, so that assembly 40 may be pivotally swung beneath the stretcher frame.

Post 42 is held in its raised position by a latch mechanism 70. A catch bar 72 extends, as will be described in detail below, outwardly from the open lower end of post 42. A catch plate 74 is secured by welding to frame member 28 to extend toward latch bar 72. Catch plate 74 includes both a catch surface 76 and at least one upright wall 78 to provide reinforcement. Latch bar 72 rests on surface 76, thereby holding side rail assembly 40 in its raised position.

Side rail assembly 40 is released by withdrawing latch bar 72 into post 42 and away from catch surface 76. This movement is caused by pivotal motion of handle 50 in the direction generally indicated by arrow 80.

Figure 4:
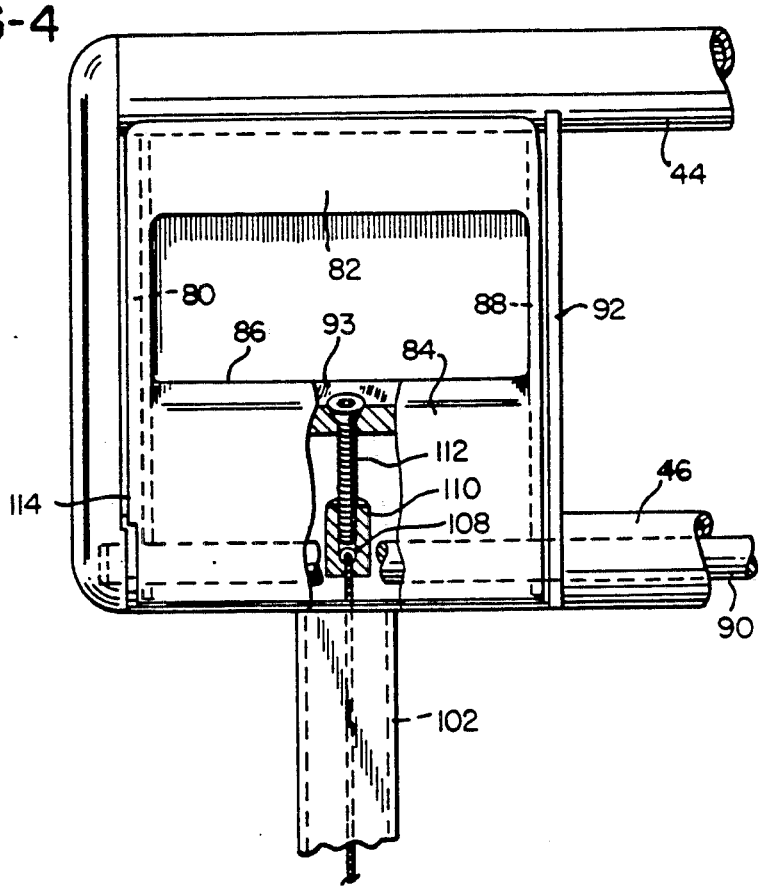
FIG. 4 is a front plan view taken generally along line 4—4 in FIG. 3, showing a handle used for lowering the side rail assembly.

Handle 50 may be seen in detail by reference to FIGS. 3 and 4. It will be understood that a second handle 50 is provided at the opposite end of side rail assembly 40, and is of identical, although mirror-image, construction. Handle 50 is provided with upper and lower portions 82 and 84, respectively, which define therebetween an opening 86. A pair of side ridges 88 are formed on the rearward size of handle 50 for purposes of reinforcement. Handle 50 is fixedly attached to a shaft 90, which is rotatably secured within side rail assembly 40 so as to permit pivotal motion of handle 50. A handle housing assembly 92, located at the top of post 42 and at the end of side rails 44 and 46, surrounds the handle so that only the forward surface of handle 50 is presented to an attendant.

A flange 93 extends rearwardly from the upper edge of lower portion 84 at opening 86. Flange 93 extends between reinforcing ribs 88, and may serve in part as a stop acting against housing 92 to limit inward pivotal movement of handle 50.

Figure 5:
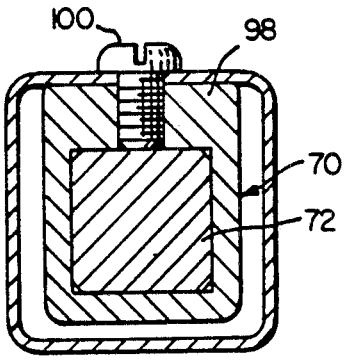
FIG. 5 is a sectional view taken generally along line 5—5 of FIG. 3.

Latch mechanism 70 can be best seen by reference to FIGS. 3 and 5. As shown in FIG. 5, latch bar 72 is slidably fitted within a sleeve 98 that is mounted by screws 100 to the upper inner surface of the bottom end of post 42. A cable 102 is connected to the rear end of latch bar 72 and passes through the rear wall of guide sleeve 98. A spring 106 is disposed about cable 102 and between the rear walls of latch bar 72 and sleeve 98. Spring 106 thus acts to urge latch bar 72 outwardly from post 42.

Cable 102 extends upwardly through post 42 and into handle housing 92. Referring also to FIG. 4, the upper end of cable 102 is provided with an end fitting 108 that cooperates with a cable nut 110. Nut 110 in turn is fittable onto a threaded screw 112 which is secured into a threaded opening in flange 93 of handle 50.

As can be seen, the extent to which cable nut 110 is secured onto screw 112 will determine the outermost position of latch bar 72, which is connected to the opposite end of cable 102 from cable nut 110. To provide some adjustment of cable tension following assembly of handle 50, screw 112 may be rotated to move cable nut 110 along the screw.

Operation of latch 70 can be appreciated from the foregoing description. An attendant grips handle 50 through opening 86, and rotates the handle about a pivot defined by shaft 90. This in turn draws cable 102 upwardly, which pulls latch bar 72 against spring 106 and away from catch surface 76. Once bar 72 has completely cleared surface 76, side rail assembly 40 may be lowered. Spring 106 then serves to return latch bar 72 to its original position, as well as to pivot handle 50 back into housing 92.

When side rail assembly 40 is subsequently raised, the inclined leading surface 116 of latch bar 72 will contact the inclined leading surface 118 of catch surface 76. Further lifting of assembly 40 will force latch bar 72 inwardly, compressing spring 106, until bar 72 has completely cleared catch surface 76. Spring 106 will then urge bar 72 to its original location, holding assembly 40 in it raised position.

Referring again to FIG. 4, it can be seen that shaft 90 extends beyond handle 50 along the interior of rail 46. At the opposite end of rail 46, shaft 90 is connected to the opposite handle 50, so that pivotal movement of either handle 50 causes similar pivotal movement of the other. Thus, an attendant need actuate only one handle to release side rail assembly 40, and can do so with one hand from either end of the stretcher, depending on whichever is more convenient. Further, it will be recognized that by positioning handles 50 on the side rail assembly, rather than the stretcher frame, the attendant can lower side rail assembly 40 while in a standing position, thus being in a better location to focus attention upon the patient occupying the stretcher.

Figure 6:
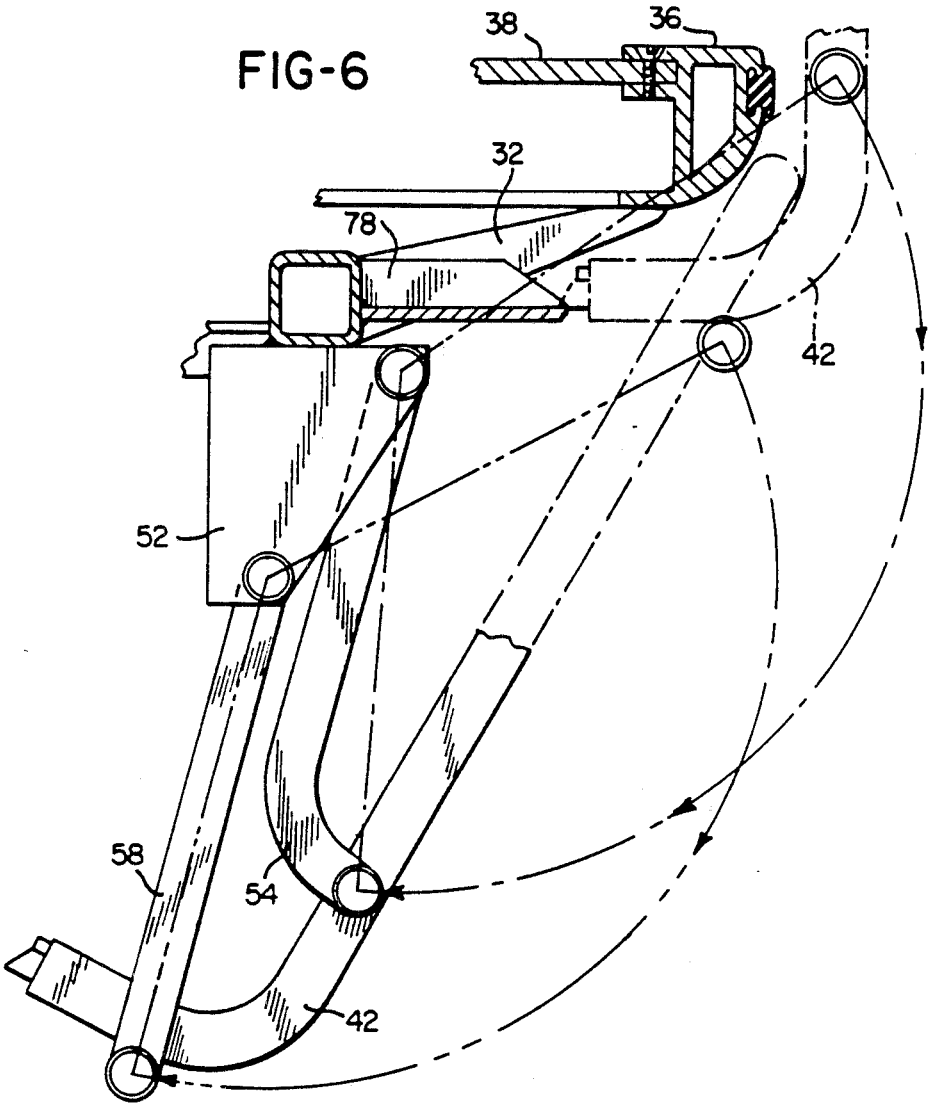
FIG. 6 is a view generally similar to FIG. 2, showing movement of the side rail from its raised to its lowered position.

Movement of the side rail assembly from its raised to its lowered position can be seen by reference to FIG. 6. By connecting linkage rods 54 and 58 so as to define a quadralateral wherein at least one pair of opposing sides are of unequal length, side rail assembly 40 is inclined outwardly as it is moved downwardly. In the preferred embodiment, the quadrilateral side effectively defined by plate 52 is shorter than the side defined by post 42. Thus, side rail assembly 40 is moved well beneath the bed surface of stretcher 10, so that assembly 40 does not interfere with placing a patient on or removing a patient from the stretcher. This is particularly advantageous when the patient is being transferred between the stretcher and another bed-like device. Further, little or no outward motion of the side rail assembly with respect to the stretcher occurs during lowering and raising of the side rail. Thus, the side rail may be lowered even when little clearance is available between the stretcher and a wall, furnishing, piece of equipment, or the like.

Because of the lowered position of assembly 40 beneath the stretcher frame, the stretcher may be positioned flush against a second bed-like device, thereby reducing movement of the patient to a minimum. Further, it will be recognized that by positioning assembly 40 with rail 44 and the upper portions of posts 42 close to peripheral frame member 34, gripping of assembly 40 for returning the side rail assembly to its raised position is facilitated.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A side rail assembly for a bed-like stretcher, the stretcher including a bed frame having first and second frame ends for supporting a bed surface, said assembly comprising:

a tubular side rail having first and second rail ends;

first and second tubular posts, one of said posts being connected to each of said first and second rail ends;

first and second mounting members connected to said frame, one of said members being connected near each of said first and second frame ends, each of said mounting members defining thereon first and second spaced-apart pivotal connection points;

a pair of first linkage bars, one of said first bars being pivotally connected between one of said first and second posts and said first connection point of a corresponding one of said mounting members;

a pair of second linkage bars, one of said second bars being pivotally connected between one of said first and second posts and said second connection point of a corresponding one of said mounting members;

a corresponding one of each of said first bars, said second bars, said mounting members and said posts cooperating to define a pivotally connected quadrilateral whereby said posts and said side rail are supported by the frame and may be pivotally and selectively moved between a raised positon and a lowered position;

first and second handles, each handle mounted to one of said posts for actuating movement;

handle linkage means connecting said first and second handles for producing identical actuating movement by both of said handles whenever one of said handles is actuatingly moved;

latch means connected to each of said posts;

catch means mounted to the frame for cooperating with said latch means to secure said posts and said side rail in said raised position;

said latch means being for releasable movement with respect to said catch means when an actuating force is applied to said latch means; and latch actuator means connected to said latch means for applying said actuating force thereto;

said latch actuator means further being connected to said first and second handles, whereby actuating movement of said handles causes said actuator means to apply said actuating force to said latch means.

2. The side rail assembly as defined in claim 1, wherein said quadrilateral is defined such that said posts are supported by the frame substantially beneath the frame when in said lowered position.

3. The side rail assembly as defined in claim 2, wherein said quadrilateral is further defined such that said posts are supported by the frame in a vertical orientation when in said raised position.

4. The side rail assembly as defined in claim 3, wherein said quadrilateral is further defined such that said posts are supported by the frame in an outwardly inclined orientation with respect to the frame when in said lowered position.

5. The side rail assembly as defined in claim 4, wherein said quadrilateral is further defined such that a side of said quadrilateral defined by said mounting member is of lesser length than an opposing side of said quadrilateral defined by said post.

6. The side rail assembly as defined in claim 1, wherein said first and second handles are each mounted to one of said posts for pivotal movement about a horizontal line, said pivotal movement constituting said actuating movement.

7. The side rail assembly as defined in claim 6, wherein said horizontal line about which said handles are pivotal is colinear with one of said tubular side rails.

8. The side rail assembly as defined in claim 7, wherein said handle linkage means includes a shaft extending through said tubular side rail, said shaft being connected to each of said handles for rotational movement upon pivotal movement of one of said handles.

9. The side rail assembly as defined in claim 8, wherein said actuating means includes a cable connecting each of said latch means with one of said handles, whereby pivotal movement of said handles applies said pulling force to said cables for application to said latch means.

10. The side rail assembly as defined in claim 1, wherein said actuating force upon said latch means is a pulling force.

* * * * *